United States Patent [19]

Schwartz et al.

[11] Patent Number: 4,637,793

[45] Date of Patent: Jan. 20, 1987

[54] FLARE GAS BURNER

[75] Inventors: Robert E. Schwartz; Roger K. Noble; Michael R. Keller, all of Tulsa, Okla.

[73] Assignee: John Zink Company, Tulsa, Okla.

[21] Appl. No.: 798,855

[22] Filed: Nov. 18, 1985

Related U.S. Application Data

[63] Continuation of Ser. No. 645,420, Aug. 29, 1984, Pat. No. 4,579,521.

[51] Int. Cl.[4] ..... F23Q 9/00

[52] U.S. Cl. ..... 431/202; 431/284

[58] Field of Search ..... 431/202, 284, 285

[56] References Cited

U.S. PATENT DOCUMENTS

| | | | |
|---|---|---|---|
| 2,506,972 | 5/1950 | Schellentrager et al. | 431/202 |
| 2,537,091 | 1/1951 | Rodman et al. | 431/202 |
| 3,730,673 | 5/1973 | Straitz | 431/202 |

*Primary Examiner*—Carroll B. Dority, Jr.

*Attorney, Agent, or Firm*—Laney, Dougherty, Hessin & Beavers

[57] ABSTRACT

A flare gas burner is provided which is less susceptible to damage caused by internal and/or external burning. An internal protective liner is attached within the burner and an external protective covering is attached over the exterior of the burner and conduits associated therewith whereby the burner is shielded from flame impingement and excessive heat and an aerodynamically improved exterior surface is provided on the burner.

3 Claims, 7 Drawing Figures

FLARE GAS BURNER

This is a continuation of co-pending application Ser. No. 645,420 filed on Aug. 29, 1985 and now U.S. Pat. No. 4,579,521.

BACKGROUND OF THE INVENTION

1. Field of the Invention

The present invention relates generally to a flare gas burner, and more particularly, but not by way of limitation, to an improved flare gas burner adapted to be connected to a flare gas conduit or stack.

2. Description of the Prior Art

Flares are commonly utilized for disposing of gases, both waste gases and gases flared as a result of equipment shut-downs, plant upsets, etc. The flared gases are burned by a flare burner either continuously or intermittently, and to insure that the flared gases are ignited and that the burning thereof is maintained, continuously burning pilot flames are provided at the flare gas burner.

While a variety of flare gas burner designs and multiple burner arrangements have been developed and used heretofore, in applications where a high maximum flow rate of flare gas is to be handled by the flare, a single flare gas burner of relatively large diameter is often used. Unfortunately, most of such flares seldom, if ever, operate at the maximum flow condition, and consequently, the flares frequently handle gas flow rates which are only small fractions of the maximum. The low flow rates in combination with wind acting on the flare gas burner often cause internal and external burning which bring about the early failure of the burner.

Internal burning occurs as a result of wind blowing transversely to the longitudinal axis of a flare gas burner when a low rate of gas is flowing through the burner. The wind causes a low pressure zone to develop within the open discharge end of the burner which in turn causes air to be drawn into the burner. As the air and gas mix within the burner, internal burning takes place. Such internal burning can cause flame impingement and excessive heat damage to the internal walls of the burner which can and usually does drastically shorten the life of the burner.

While increased gas flow rates overcome the problem with internal burning, the combination of a gas flow rate which is still less than maximum and wind can bring about an undesirable condition of external burning. That is, as wind strikes a flare gas burner, a high pressure zone is developed on the windward side and a low pressure zone is developed on the leeward side. At certain less than maximum flow rates of gas through the flare gas burner, the low pressure zone created by the wind and the wind force against the flame above the burner cause a portion of the flame to move or to be pulled into the low pressure zone on the leeward side of the flare burner. This in turn brings about flame impingement and excessive heat damage to wall portions of the burner and its appurtenances.

Low pressure zones which promote external burning are also readily formed by wind acting on the portions of flare burners which extend outwardly from the external sides of the burners such as pilot flame fuel gas conduits, ignitor apparatus and the like. External burning in such low pressure zones brings about damage to the burner as well as to the conduits and other protruding portions thereof.

By the present invention, an improved flare gas burner is provided which is shielded from flame impingement, heat, etc., brought about by internal and/or external burning thereby significantly increasing the operational life of the burner.

SUMMARY OF THE INVENTION

A flare gas burner adapted to be connected to a flare gas conduit comprised of a tubular member having a discharge end and an inlet end. An internal protective liner formed of refractory material is attached within the tubular member at the discharge end thereof and an external protective covering formed of refractory material is attached over the exterior walls of the tubular member at the discharge end thereof. Pilot flame burner means are positioned adjacent the discharge end of the tubular member which are connected to conduit means. The conduit means are disposed within the external protective covering whereby they are shielded and an aerodynamically improved external surface is provided at the discharge end of the burner.

It is, therefore, a general object of the present invention to provide an improved flare gas burner.

Another object of the present invention is the provision of a flare gas burner which is shielded to reduce the damaging effects of flame impingement, excessive heat, etc., caused by internal and/or external burning.

A further object of the present invention is the provision of a flare gas burner wherein the burner as well as pilot flame burner fuel gas and igniter conduits are shielded by protective coverings of refractory material to thereby substantially lessen damage resulting from internal and/or external burning and to provide an aerodynamically improved external surface on the burner.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 1:
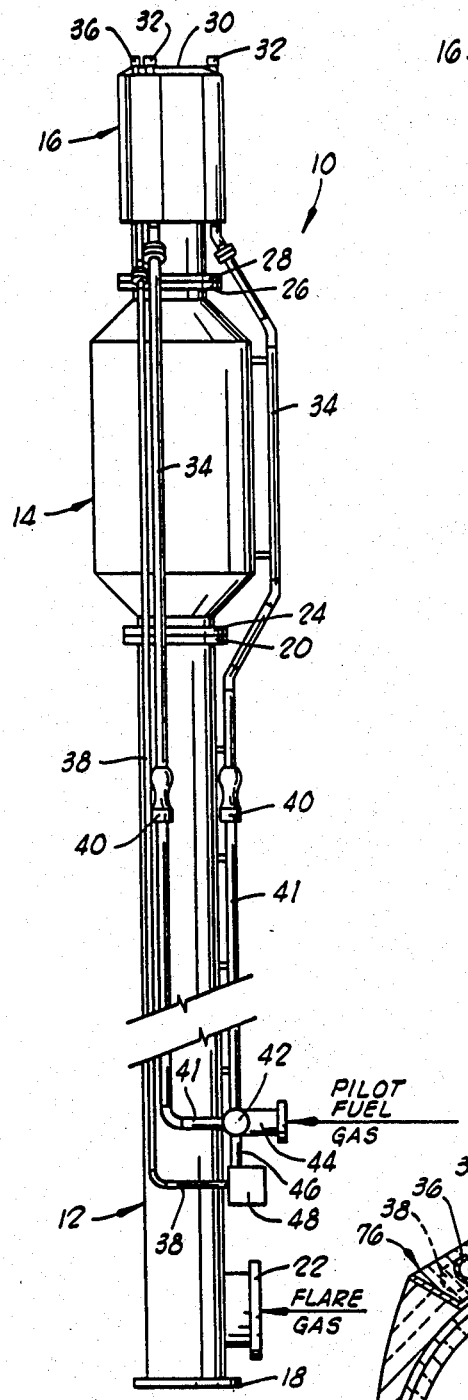
FIG. 1 is a side elevational view of a typical flare stack including the flare gas burner of the present invention.

Referring now to the drawings, and particularly to FIG. 1, a typical flare stack which includes the flare gas burner of the present invention is illustrated and generally designated by the numeral 10. The flare stack 10 can be positioned vertically and can include a lower conduit section 12, an air seal section 14 and the flare gas burner of the present invention 16 (the top section). The lower section 12 of the flare stack 10 is a conduit sized to handle the maximum flow rate of gas to be flared having a closed bottom end or base 18 and a flange connector 20 at the top end. A flanged inlet connection 22 is provided adjacent the base 18.

The air seal section 14 is of a known design and functions to prevent air from back-flowing into or otherwise infiltrating into the waste gases contained within the flare stack whereby an explosive mixture results. A particularly suitable such air seal is described in U.S. Pat. No. 3,055,417 issued to R. D. Reed on Sept. 25, 1962. The air seal 14 includes an inlet flange connector 24 at its lower end which is connected to the flange 20 of the lower stack section 12 and a discharge flange connector 26 at the upper end thereof.

The flare gas burner 16 includes an inlet flange 28 at its lower end which is connected to the flange 26 of the air seal 14 and an upwardly facing discharge opening 30 at the upper end thereof. Three pilot flame burners 32 are positioned around the periphery of the discharge opening 30 which are connected to conduits 34. Positioned adjacent the pilot flame burners 32 are ignitor heads 36 which are connected to conduits 38 extending to the bottom portion of the flare stack 10. The conduits 34 connect to air-fuel gas mixers 40 which are in turn connected to a fuel gas header 42 by conduits 41. Fuel gas header 42 includes a fuel gas inlet connection 44 attached thereto and is connected by a conduit 46 to an ignitor apparatus 48 which is in turn connected to the conduits 38.

In operation of the flare stack 10, gas to be flared is conducted to the flare gas inlet 22 of the stack 10 from where it flows upwardly through the lower section 12, through the air seal 14 and then through the flare gas burner 16 to the atmosphere. As the flare gas flows through the discharge opening 30 of the burner 16 into the atmosphere, it is ignited by the pilot flames continuously emitted from the burners 32 and burned.

Fuel gas is supplied from a source thereof to the pilot fuel gas header 42 by way of the inlet connection 44 thereof. The fuel gas flows through the conduits 41 to the fuel gas-air mixers 40 wherein the fuel gas mixes with air and the resulting mixture flows by way of the conduits 34 to the pilot burners 32.

Pilot flames are continuously produced at the pilot burners so that whenever flare gas flows through the stack 10 and discharges from the burner 16, it is ignited and burned. When the pilot burners are initially ignited or when they have to be reignited, the ignitor system comprised of the ignitor heads 36 positioned adjacent the pilot flame burners 32, the conduits 38 and the ignitor apparatus 48 is utilized. That is, the ignitor apparatus 48 produces a fuel gas-air mixture which is ignited and caused to flow by way of the conduits 38 to the ignitor heads 36. When the burning gas-air mixture reaches and is discharged from the heads 36 adjacent the pilot flame burners 32, fuel-air mixtures emitted from the burners 32 are ignited thereby. As is well understood by those skilled in the art, various pilot flame ignitor systems and apparatus have been developed which are commercially available, any of which can be utilized with the flare stack 10.

While the flare stack 10 illustrated in FIG. 1 and described above is typical of a number of flare installations, it is to be understood that the flare gas burner 16 of the present invention can be utilized in various other installations. For example, the burner 16 can be connected to the end of a stack or conduit not including an air seal and the conduit can be positioned vertically, horizontally or at an angle therebetween. Also, one or more burners 16 can be connected directly to a flare gas header.

Figure 3:
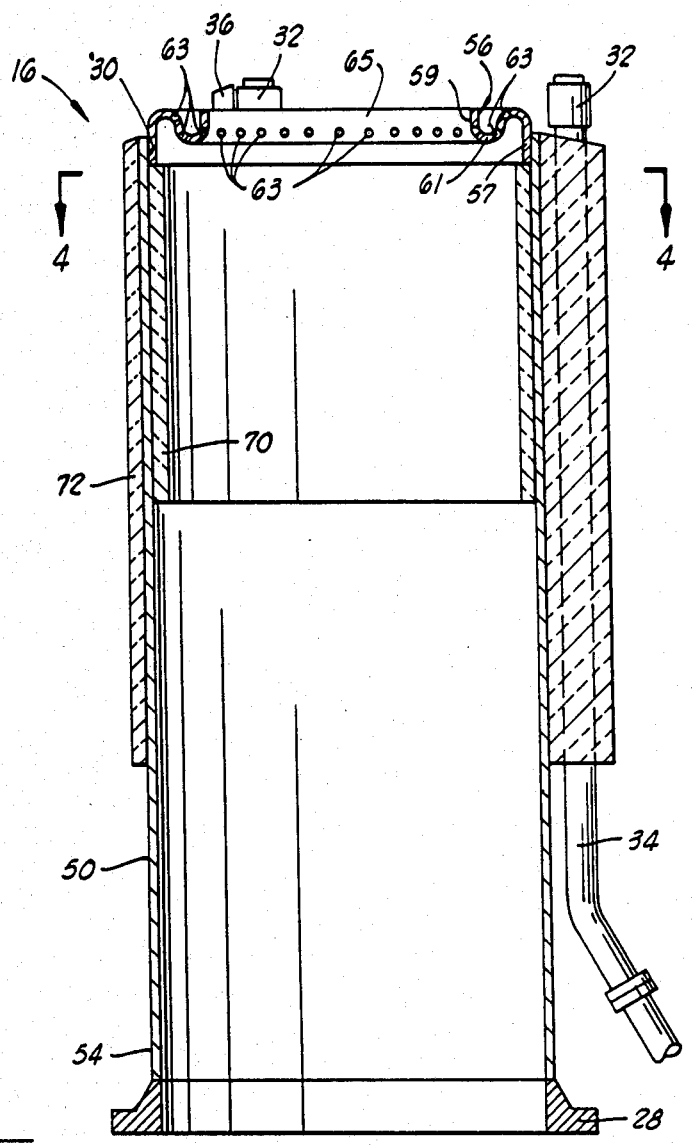
FIG. 3 is a side elevational cross-sectional view of the flare gas burner of FIG. 2.
Figure 4:
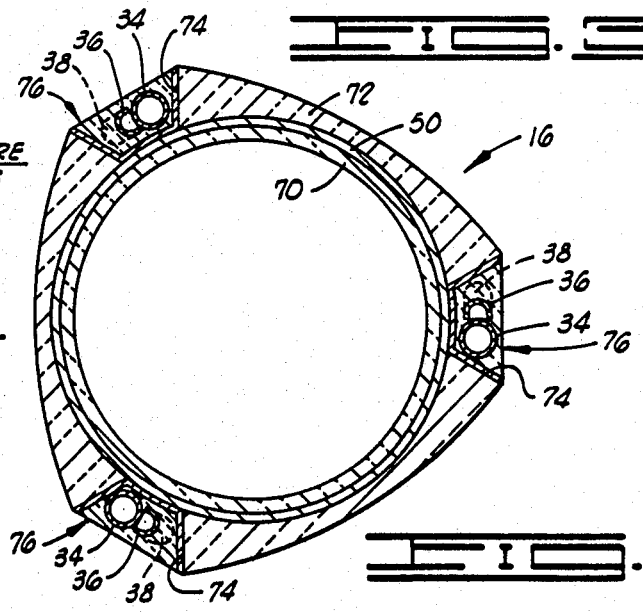
FIG. 4 is a cross-sectional view taken along line 4—4 of FIG. 3.
Figure 2:
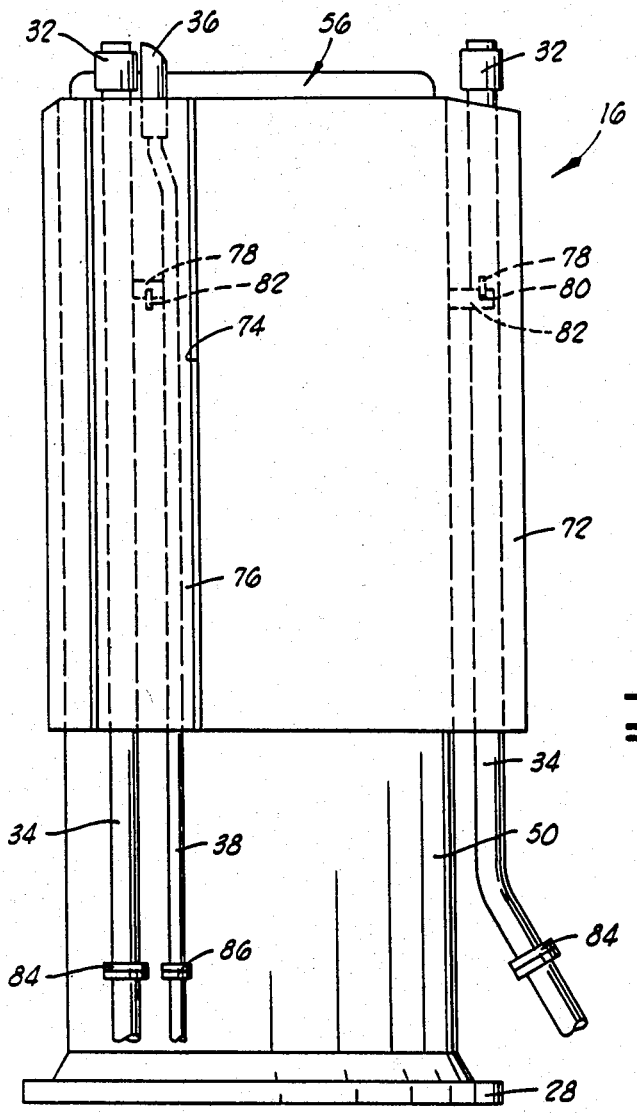
FIG. 2 is a side elevational view of one form of flare gas burner of the present invention.

Referring now to FIGS. 2–4, the flare gas burner 16 of FIG. 1 is illustrated in detail. The burner 16 is comprised of a tubular member 50 which has an open upper end forming the flare gas discharge opening 30. The flange 28 is welded to the lower end 54 of the tubular member 50. In a preferred form, a flame retention device 56 is attached to the discharge opening 30 of the tubular member 50. The device 56 includes a cylindrical outer wall 57 connected to a cylindrical inner wall 59 by an undulated connecting wall 61. A plurality of ports 63 are disposed in the undulated connecting wall 61 and the inner wall 59 forms a central circular discharge opening 65. The flame retention device 56 increases the velocity of the flare gases as they flow through the central opening 65 formed by the wall 59 and the portions of the flare gases flowing through the ports 63 are burned adjacent the device 56 so that the burning of the main body of gases flowing through the central opening is maintained adjacent the device 56.

Disposed within the upper portion of the tubular member 50 and attached thereto is an internal protective liner 70 formed of refractory material. The term "refractory material" is used herein to mean any material having the ability to endure or resist high temperatures. An external protective covering 72 formed of refractory material is attached to the upper portion of the exterior walls of the tubular member 50. As best shown in FIG. 4, the exterior protective covering 72 includes three spaced apart longitudinal channels of trapezoidal cross-sectional shape 74 formed therein. The channels 74 extend from the bottom of the covering 72 to the top thereof, and in the embodiment illustrated in FIG. 4, the external covering 72 is thickest at the locations of the channels 74 formed therein and thinnest at points intermediate the channels 74. This arrangement of the external covering is utilized to conserve refractory material where the diameter of the tubular member 50 is large.

Disposed within each of the channels 74 is an assembly 76 comprised of an upper portion of one of the conduits 34 attached to a pilot flame burner 32, an upper portion of one of the ignitor conduits 38 attached to an ignitor head 36 and a protective covering of refractory material surrounding the conduit portions. The refractory material covering is formed in a trapezoidal cross-sectional shape which is complementary to the cross-sectional shape of the channel 74 whereby an aerodynamically improved external surface is provided on the tubular member 50 adjacent the upper end portion thereof.

As shown in FIG. 2, each of the assemblies 76 is removably connected within a channel 74 by a lug 78 attached to and between the conduits 34 and 38 at a point near the upper end of the assembly 76 which fits into a vertical slot 80 formed in a second lug 82 positioned transversely to the lug 78 and attached to the member 50. In order to allow the removal of the assemblies 76 and the replacement of burners or other parts thereof, bolted flange connections or equivalent means 84 and 86 are provided in the conduits 34 and 38, respectively, at points below the assemblies 76. Thus, in order to remove an assembly 76 from the flare gas burner 16, the flange connections 84 and 86 in the conduits 34 and 38 are disconnected whereby the assembly 76 can be moved upwardly and outwardly to disengage the lug 78 from the lug 82.

In operation of the flare gas burner 16, if internal or external burning occurs as a result of a particular combination of wind and flare gas flow rate, the internal and external surfaces of the tubular member 50 as well as the conduits 34 and 38 are protected from flame impingement, excessive heat, and other adverse conditions brought about by such burning. In addition, the external surface of the upper portion of the burner 16 is aerodynamically improved, i.e., conduits and other parts do not protrude outwardly from the sides thereof, whereby low pressure areas associated with such protrusions which promote external burning are eliminated. While the pilot flame burners 32 and ignitor heads 36 are exposed, these components are easily replaced when necessary by temporarily removing the assemblies 76, replacing the parts and then reinstalling the assemblies 76.

Figure 5:
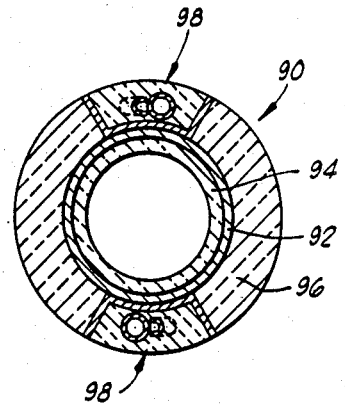
FIG. 5 is a cross-sectional view similar to FIG. 4 but illustrating an alternate form of flare gas burner of the present invention.
Figure 6:
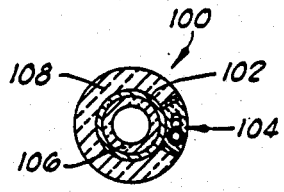
FIG. 6 is a cross-sectional view similar to FIG. 5 but illustrating yet another alternate form of the flare gas burner of the present invention.

Referring now to FIGS. 5 and 6, alternate embodiments of the flare gas burner of the present invention are illustrated and generally designated by the numerals 90 and 100, respectively. The burner 90 of FIG. 5 includes a relatively small tubular member 92 having an internal protective liner formed of refractory material 94 attached thereto and an external protective covering formed of refractory material 96 attached thereto. Because the tubular member 92 is of relatively small diameter as compared to the tubular member 50 of the burner 16 previously described, only two pilot flame burner and ignitor assemblies 98 are utilized and the external covering 96 is of a uniform thickness.

The flare gas burner 100 illustrated in FIG. 6 is identical to the burner 90 of FIG. 5 except that the diameter of the tubular member 102 is even smaller than the tubular member 92 of the burner 90, and consequently, only one pilot flame burner and ignitor assembly 104 is required. The burner 100 includes an internal liner 106 and an external covering 108, both formed of refractory material.

As will be understood, the particular number of pilot flame burners utilized with the flare gas burner of this invention depends on a number of design factors such as the maximum flow rate of flare gas, prevailing wind conditions at the location of use, etc. Accordingly, this invention is not to be limited to any particular number of pilot flame burners, ignitors and associated conduit means.

Figure 7:
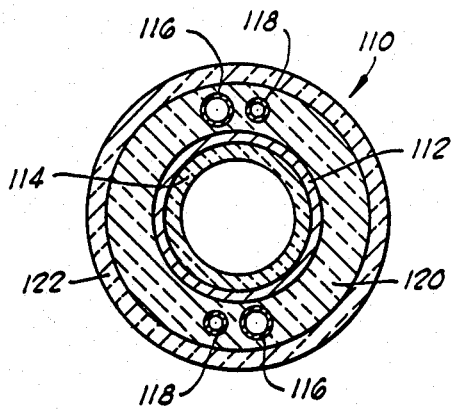
FIG. 7 is a cross-sectional view similar to FIG. 5 but illustrating still another alternate form of the flare gas burner of the present invention.

In some applications of the flare gas burner of this invention, it is not necessary that the conduit means connected to ignitors and/or pilot flame burners be removable. In such applications, the pilot flame burner or burners and ignitor head or heads, if utilized, can be removed from the conduits connected thereto, but the conduits are permanently disposed within the external refratory covering. Referring to FIG. 7, a flare burner 110 of this type is illustrated. The burner 110 includes a tubular member 112 having an internal protective liner formed of refractory material 114 attached thereto. Pilot flame burner conduits 116 and ignitor conduits 118 are positioned on opposite sides of the tubular member 112 and are encased in an external covering of refractory material 120. A technique which has been found to be particularly suitable in forming the external refractory covering on burners with conduits permanently disposed within the covering is to form the covering 120 encasing the conduits 116 and 118 of a refractory material which is relatively soft and flexible followed by the forming of a hard inflexible outside refractory material covering 122 thereover. The soft flexible material of the covering 120 allows a limited movement of the conduits 116 and 118 therewithin which is sometimes necessary when installing the burner 110.

In some applications such as where the maximum flow rate of gas to be flared by a burner of this invention is so low that the burner is of very small diameter, it is sometimes impossible or impractical to include an internal protective liner in the burner. In other circumstances, the characteristics of the application may be such that the use of an internal lining is not required. However, in such instances an external protective covering is attached to the burner and the pilot flame burner and ignitor conduits are disposed therewithin.

Thus, the present invention is well adapted to carry out the objects and attain the ends and advantages mentioned as well as those inherent therein. While numerous changes in the arrangement and construction of parts can be made by those skilled in the art, such changes are encompassed within the spirit of this invention as defined by the appended claims.

What is claimed is:

1. In a tubular flare gas burner having an inlet end adapted to be mounted to a flare gas conduit and having a discharge end, the improvement whereby said burner is less susceptible to damage caused by internal and/or external burning comprising:

an internal protective liner formed of refractory material attached within at least the discharge end portion of said burner whereby the internal surfaces of said burner are shielded from flame impingement and excessive heat caused by internal burning;

pilot burner means positioned adjacent the discharge end of said burner including conduits extending along and adjacent the external surfaces of said burner between the discharge and inlet ends thereof; and an external protective covering formed of refractory material attached to and over at least the discharge end portion of said burner and the conduits of said pilot burner means extending therealong whereby the external surfaces of said burner and said conduits are substantially shielded from flame impingement and excessive heat caused by external burning and an aerodynamically improved external surface is provided on the discharge end portion of said burner, said external protective covering being comprised of relatively soft and flexible refractory material encasing said external burner surfaces and said conduits and covered by a hard inflexible refractory material.

2. A flame impingement and heat shielded flare gas burner comprising:

a tubular member having a discharge end and an inlet end;

pilot flame burner means comprised of at least one pilot flame burner removably attached to conduit means positioned adjacent said discharge end of said tubular member, said conduit means extending along the external sides of said tubular member between the discharge end and inlet end thereof; and an external protective covering formed of refractory material attached over the external sides of at least the discharge end portion of said tubular member and over said conduit means extending therealong whereby said tubular member and said conduit means are shielded and covered by said external protective covering and an aerodynamically improved external discharge end portion is provided on said tubular member, said external protective covering being comprised of relatively soft and flexible refractory material encasing said tubular member and conduit means and covered by a hard inflexible refractory material.

3. A flame impingement and heat shielded flare gas burner comprising:

a tubular member having a discharge end and an inlet end;

an internal protective liner formed of refractory material attached within said tubular member at least at the discharge end portion thereof;

pilot flame burner means comprised of a plurality of pilot flame burners removably attached to conduit means positioned adjacent said discharge end of said tubular member said conduit means extending along the external sides of said tubular member between the discharge end and inlet end thereof; and an external protective covering formed of refractory material attached over the external sides of at least the discharge end portion of said tubular member and over said conduit means extending therealong whereby said tubular member and said conduit means are shielded and covered by said external protective covering and an aerodynamically improved external discharge end portion is provided on said tubular member, said external protective covering being comprised of relatively soft and flexible refractory material encasing said tubular member and conduit means and covered by a hard inflexible refractory material.

* * * * *